US008714660B2

(12) United States Patent
Rodel et al.

(10) Patent No.: US 8,714,660 B2
(45) Date of Patent: May 6, 2014

(54) CHAMBER FOR MILLING MACHINE

(75) Inventors: Kevin J. Rodel, Isanti, MN (US); Benjamin T. Schafer, Elk River, MN (US); Timothy Miller, St. Paul, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/549,817

(22) Filed: Jul. 16, 2012

(65) Prior Publication Data

US 2014/0015304 A1 Jan. 16, 2014

(51) Int. Cl.
*E01C 23/088* (2006.01)

(52) U.S. Cl.
CPC ..... *E01C 23/088* (2013.01)
USPC ..... 299/39.4

(58) Field of Classification Search
USPC ..... 299/39.4, 78, 80.1; 384/542
See application file for complete search history.

(56) References Cited

U.S. PATENT DOCUMENTS

| | | | | |
|---|---|---|---|---|
| 3,779,607 | A | 12/1973 | Staab | |
| 4,193,636 | A | 3/1980 | Jakob | |
| 5,993,069 | A * | 11/1999 | Arrasmith et al. | 384/477 |
| 6,877,818 | B1 * | 4/2005 | Gaertner et al. | 299/39.8 |
| 7,144,087 | B2 | 12/2006 | Haroldsen et al. | |
| 7,144,192 | B2 * | 12/2006 | Holl et al. | 404/93 |
| 8,052,331 | B2 * | 11/2011 | Katougi et al. | 384/537 |
| 2011/0148177 | A1 * | 6/2011 | Busley et al. | 299/39.2 |
| 2011/0163589 | A1 * | 7/2011 | Cipriani et al. | 299/39.2 |

FOREIGN PATENT DOCUMENTS

| | | |
|---|---|---|
| GB | 656301 | 8/1951 |

* cited by examiner

*Primary Examiner* — David Bagnell
*Assistant Examiner* — Michael Goodwin
(74) *Attorney, Agent, or Firm* — Andrew A. Phillips

(57) ABSTRACT

A chamber for a milling machine includes a milling rotor rotatably mounted transversely on the chamber. The chamber also includes a side plate mounted on the chamber, adjacent to the milling rotor, in a substantially vertical position. The side plate includes a side plate support. The chamber further includes a rotor bearing coupled with the milling rotor and a bearing support configured to receive the rotor bearing. The chamber also includes at least one fastening element to removably couple the bearing support with the side plate support and the rotor bearing.

15 Claims, 6 Drawing Sheets

CHAMBER FOR MILLING MACHINE

TECHNICAL FIELD

The present disclosure relates to a chamber for a milling machine, and, more particularly to a bearing assembly for a milling rotor supported within the chamber of the milling machine.

BACKGROUND

One type of road construction vehicle, commonly referred to as a milling machine, generally includes a chassis and a chamber supported at a bottom side of the chassis. The chamber includes a milling rotor rotatably mounted within the chamber. The milling rotor facilitates in removing asphalt or concrete from a roadbed. For example, the milling rotor may be equipped with cutter teeth and may be powered to rotate about an axle to mill off a road surface. The axle is transversally supported between side plates of the chamber with the help of rotor bearings. Generally, a rotor bearing is supported by a bearing support on a side plate support, which is an integral part of a side plate. Typically, the bearing support is fixedly mounted (welded) on the side plate support. Therefore, whenever the rotor bearing or the milling rotor needs to be repaired, the entire side plate needs to be removed from the chamber, which in turn becomes a time consuming task.

GB 656301 patent discloses an idle end bearing of the driving drum shaft of a driving unit for a belt conveyer having a housing which spigots into a side plate of the unit and is of greater (spigot) diameter than the drum. The shaft engages its driving gear slidably so that when the housing is removed the drum and shaft may slide out without disturbing any other parts. The drums of the driving unit are keyed to the shafts, and one end of the shafts is formed with splines adapted to engage internal splines in driving gear wheels. The other end of the shafts is mounted in a bearing spigotted into and bolted to the side plate of the unit. The diameter of the apertures in the plate into which the housings fit are greater than the diameter of the drums so that when the bolts holding the housings are removed the drums may be withdrawn through the apertures.

SUMMARY

In one aspect, the present disclosure provides a chamber for a milling machine includes a milling rotor rotatably mounted transversely on the chamber. The chamber also includes a side plate mounted on the chamber, adjacent to the milling rotor, in a substantially vertical position. The side plate includes a side plate support. The chamber further includes a rotor bearing coupled with the milling rotor and a bearing support configured to receive the rotor bearing. The chamber also includes at least one fastening element to removably couple the bearing support with the side plate support and the rotor bearing.

In another aspect, the present disclosure provides a milling machine. The milling machine includes a chamber having a front portion and a rear portion, a milling rotor rotatably mounted transversely on the chamber, and a rear door mounted transversely on the chamber. The rear door is mounted adjacent to the milling rotor, in a substantially vertical position. The milling machine also includes a side plate hingedly connected to the chamber, and configured to articulate in a longitudinal direction about the milling rotor. The milling machine further includes a side plate support integral with the side plate, a bearing support configured to slide in the side plate support; a rotor bearing configured to slide in the bearing support, and at least one fastening element to removably couple the bearing support with the side plate support and the rotor bearing.

In yet another aspect, the present disclosure provides a method of accessing a chamber of a milling machine. The method includes opening at least one fastening element configured to engage a bearing support with a rotor bearing and a side plate. Thereafter, removing the bearing support from the side plate support. Further, pivoting the side plate of the chamber in a longitudinal direction about the rotor bearing and accessing the rotor bearing for performing one or more operations.

Other features and aspects of this disclosure will be apparent from the following description and the accompanying drawings.

DETAILED DESCRIPTION

Figure 1:
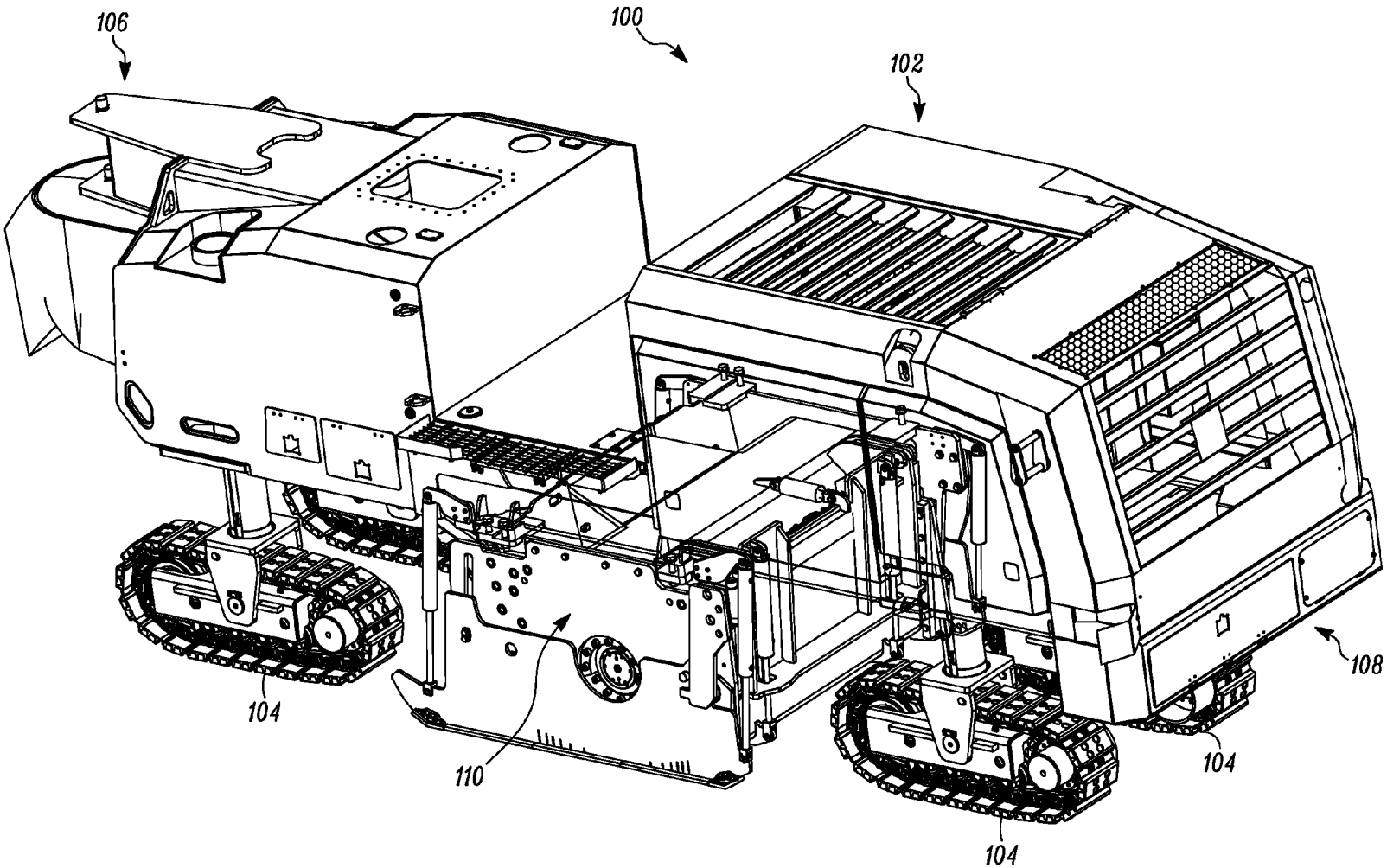
FIG. 1 illustrates a perspective view of a milling machine.

The present disclosure will now be described in detail with reference being made to accompanying figures. A machine 100 in which disclosed embodiments may be implemented is schematically illustrated in FIG. 1. In the accompanied drawings, the machine 100 is illustrated as a milling machine. The milling machine 100 may be used for milling of asphalt, concrete, and other road surface materials so that a worn surface, may be replaced with new material.

The milling machine 100 includes a chassis 102 and a traction device 104. The chassis 102 has a front end 106 and a rear end 108. A driver's position may be situated between the front end 106 and the rear end 108 of the chassis 102. The milling machine 100 also includes a chamber 110 mounted on a bottom side of the chassis 102. A person of ordinary skill in the art will appreciate that the size, shape, and structure of the milling machine 100 as well the location and dimensions of the chamber 110 are merely on an exemplary basis and do not limit the scope of the disclosure.

Figure 2:
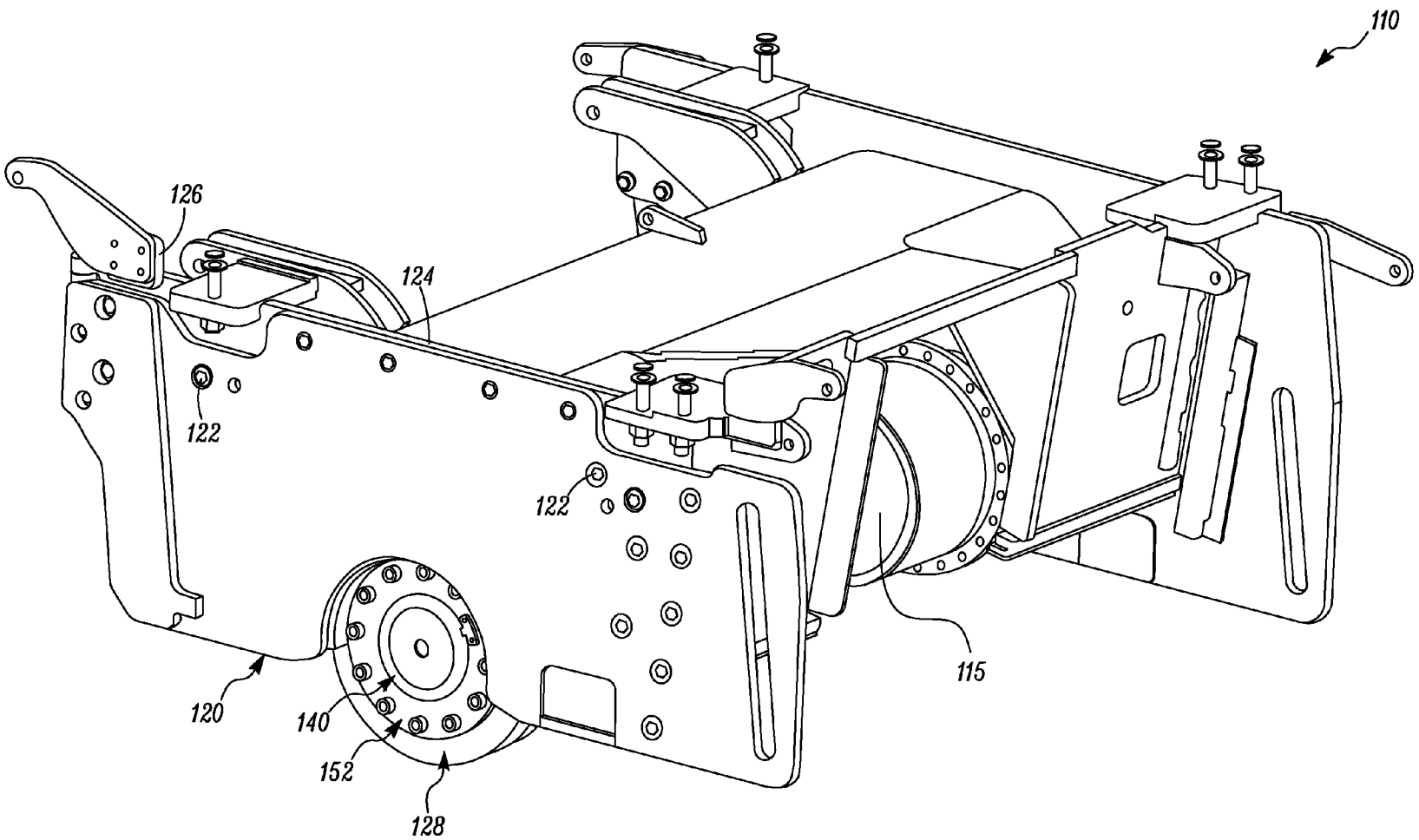
FIG. 2 illustrates a perspective view of a chamber of the milling machine.

Referring now to FIG. 2, the chamber 110 includes a milling rotor 115 mounted transversely within the chamber 110. The milling rotor 115 is adapted to be moved for contacting a road surface for the milling thereof. For example, the milling rotor 115 may be equipped with cutter teeth and may be powered to rotate about an axle for allowing the cutter teeth to mill off the road surface.

The chamber 110 also includes a side plate 120 mounted on the chamber 110, adjacent to the milling rotor 115, in a substantially vertical position. The side plate 120 is mounted on the chamber 110 with the help of fasteners, such as bolts 122. For example, the side plate 120 may be coupled to a support plate 124 with the help of the bolts 122. The side plate 120 may be further pivotally coupled to the support plate 124 with the help of a hinge 126. This allows the side plate 120 to articulate along a longitudinal direction to the milling rotor 115, i.e., the side plate 120 is adapted to be swung away from the chamber 110 in the longitudinal direction to the milling rotor 115.

The side plate 120 includes a side plate support 128. The side plate support 128 is an integral portion of the side plate 120 and facilitates in supporting the milling rotor 115. For example, the milling rotor 115 may be supported by the side plate support 128 with the help of a bearing assembly, which will be explained in detail later herein. The side plate support 128 includes an opening 130 and at least one groove, such as grooves 132, as shown in FIG. 3.

Figure 3:
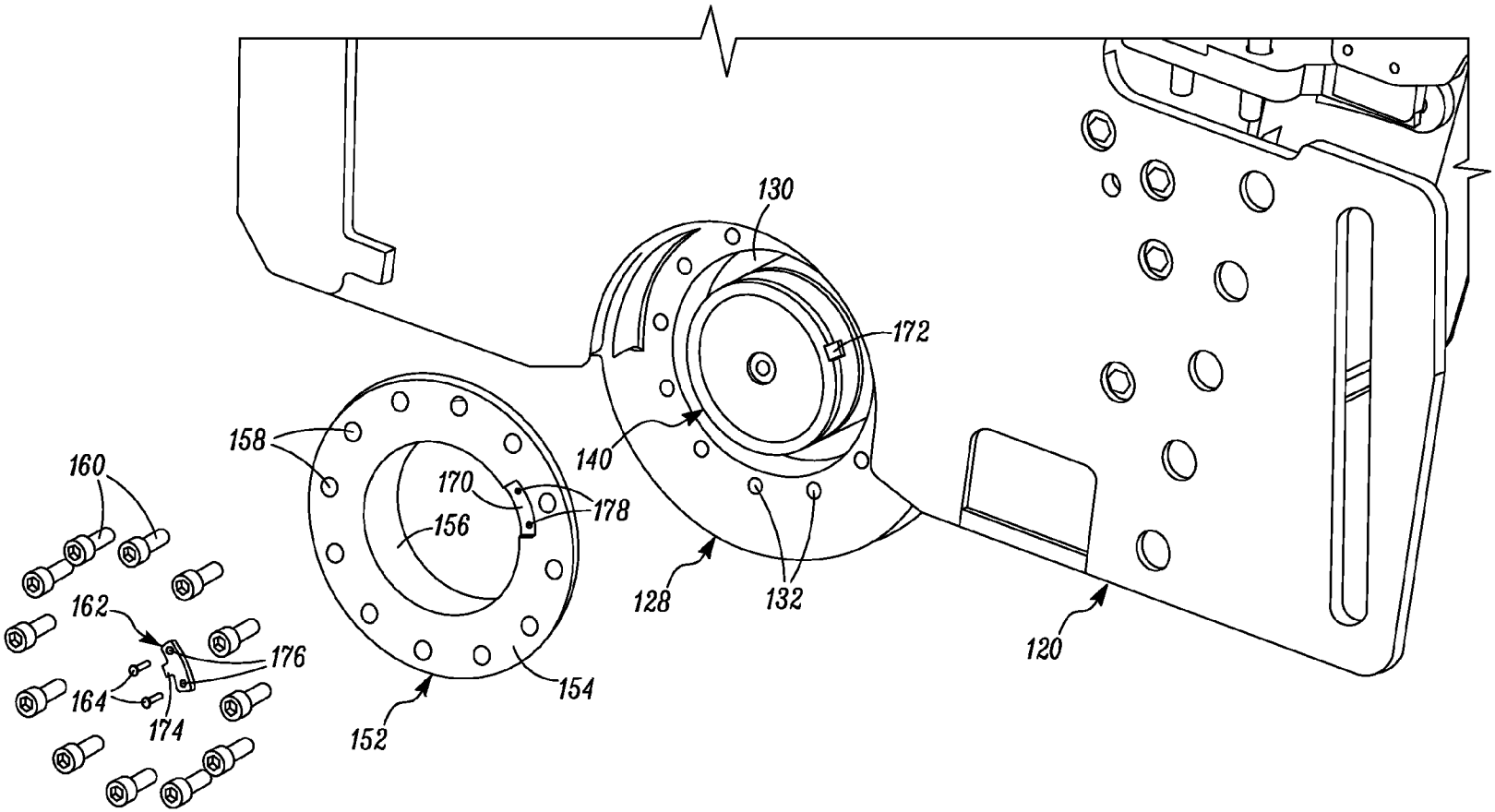
FIG. 3 illustrates a perspective view of a bearing assembly for a milling rotor in an unassembled state.

Referring now to FIG. 3, the chamber 110 also includes a rotor hearing 140. The rotor bearing 140 may be coupled to the milling rotor 115. For example, the milling rotor 115 may be supported on the axle, and one end of the axle may be coupled to the rotor bearing 140. The various components that constitute the rotor bearing 140 are best shown in FIG. 4.

Figure 4:
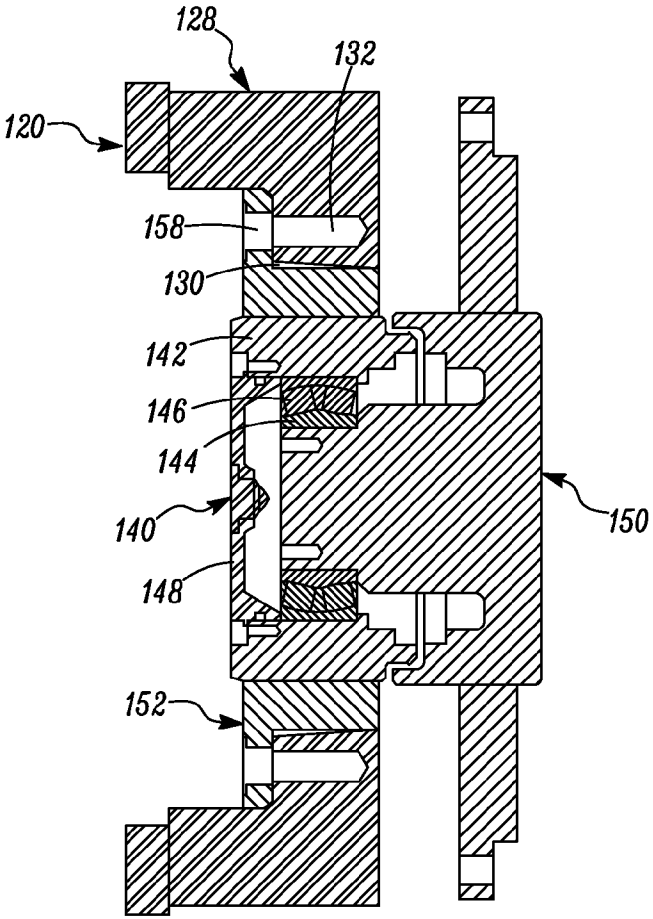
FIG. 4 illustrates a cross-sectional view of the bearing assembly in an assembled state.

FIG. 4 illustrates a cross-sectional view of the rotor bearing 140. The rotor bearing 140 includes an outer ring 142 and an inner ring 144 received within the outer ring 142. The rotor bearing 140 also includes one or more rolling elements, such as rolling elements 146, positioned between the outer ring 142 and the inner ring 144. The rotor bearing 140 may be a rolling-element hearing, such as a ball bearing or a roller bearing.

The rotor bearing 140 may also include a cover plate 148 adapted to be coupled with the outer ring 142. The cover plate 148 may help in keeping away dust and debris from the rolling elements 146 and the inner ring 144. The rotor bearing 140 may further include a bearing connector 150. The bearing connector 150 may be adapted to couple the one end of the axle with the inner ring 144 of the rotor bearing 140. This allows the milling rotor 115, supported on the axle, to be rotatably supported on the side plate support 128.

Referring back to FIG. 3, the chamber 110 also includes a hearing support 152 configured to receive the rotor bearing 140. The bearing support 152 includes a flange section 154 and a hollow protruded section 156 integral with the flange section 154. The bearing support 152 also includes at least one groove, such as grooves 158, configured on the flange section 154 of the bearing support 152. The grooves 158 of the flange section 154 conform to the grooves 132 of the side plate support 128.

In the present embodiment, the flange section 154 of the bearing support 152 is configured to have a circular plate like structure. However, it may be evident to those skilled in the art that the flange section 154 may be configured to have an oval or a polygonal plate like structure. Further, the hollow protruded section 156 is configured to have a hollow cylindrical shape conforming to a shape of the circular opening 130 of the side plate support 128. This allows the hollow protruded section 156 to slide into (received by) the opening 130. In the present embodiment, the opening 130 is configured to be a tapered opening, which allows the hollow protruded section 156 to be conveniently received by the opening 130. For example, as shown in FIG. 4, the opening 130 is the tapered opening for conveniently receiving the hollow protruded section 156 therethrough.

Once the hollow protruded section 156 is received by the opening 130, the outer ring 142 of the rotor bearing 140 is received by the hollow protruded section 156. It is to be understood that, the hollow protruded section 156 (having hollow cylindrical shape) also conforms to the outer ring 142 of the rotor hearing 140 that generally includes a cylindrical shape.

As shown in FIG. 3, the chamber 110 also includes at least one fastening element to removably couple the bearing support 152 with the side plate support 12$ and the rotor bearing 140. The at least one fastening element may include bolts 161) adapted to couple the bearing support 152 with the side plate support 128. For example, the grooves 158 on the flange section 154 may align with the grooves 132 of the side plate support 128, thereafter the bolts 160 may be received therethrough for coupling the bearing support 152 with the side plate support 128. The bolts 160 provide removable coupling to the bearing support 152 with the side plate support 128.

As mentioned above, the at least one fastening element is also adapted to removably couple the bearing support 152 with the rotor bearing 140. The at least one fastening element may include a bearing support key 162 and bolts 164 for removably coupling the bearing support 152 with the rotor hearing 140. The hearing support key 162 and the bolts 164 utilize a slot 170 configured on the flange section 154, and a slot 172 configured on the rotor hearing 140 for removably coupling the bearing support 152 with the rotor bearing 140. The slot 170 corresponds (inline) with the slot 172.

The slot 170 is adapted to receive the bearing support key 162 therein. The bearing support key 162 includes a key portion 174. The key portion 174 is adapted to be received by the slot 172, when the bearing support key 162 is received in the slot 170. Thereafter, the bolts 164 may be received through holes 176, 178 configured on the bearing support key 162 and the slot 170, respectively. This allows the bearing support key 162 to rigidly engage with the slot 170.

Further, the key portion 174 of the bearing support key 162 rigidly engages with the slot 172, configured on the outer ring 142 of the rotor hearing 140. This allows the outer ring 142 of the rotor bearing 140 to be stationary or rigidly engage with the bearing support 152, whereas the inner ring 144 is adapted to rotate about the outer ring 142 with the help of the rolling elements 146. Accordingly, the hearing connector 150, coupled to the inner ring 144, is adapted to rotate for providing a rotary motion to the axle supporting the milling rotor 115.

Figure 5:
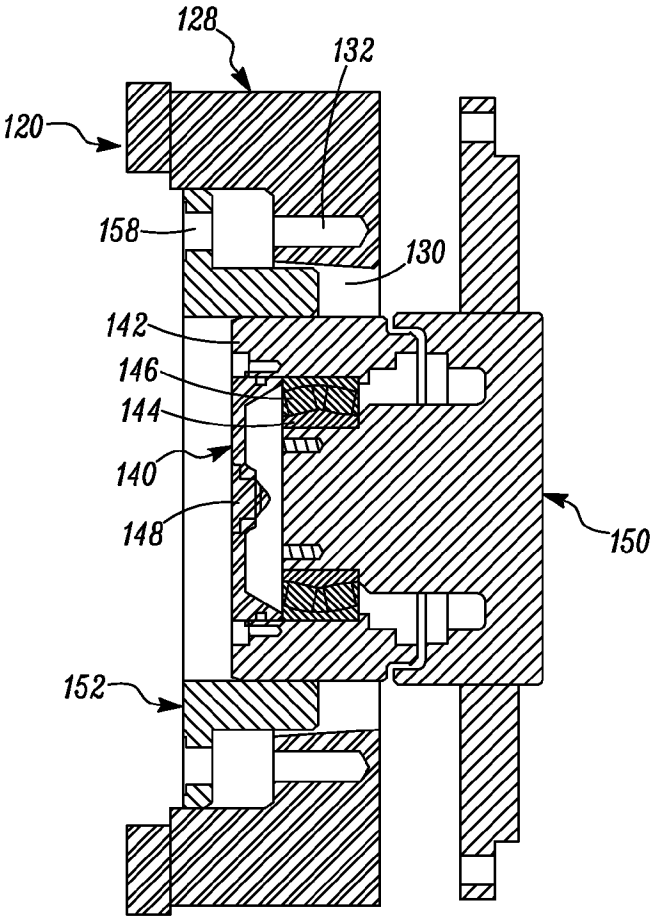
FIG. 5 illustrates a cross-sectional view of the bearing assembly in an partially unassembled state.
Figure 6:
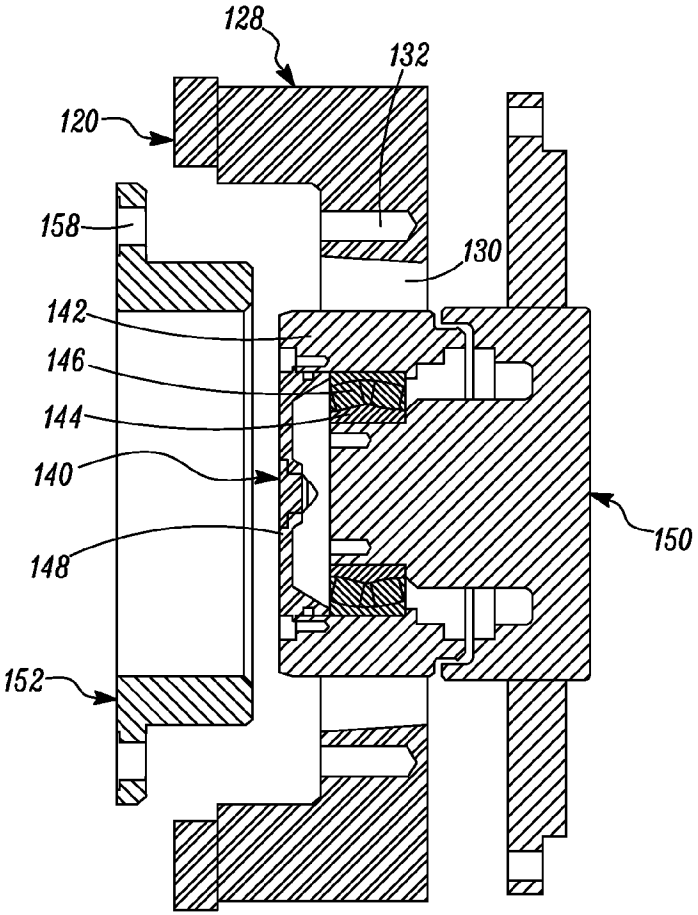
FIG. 6 illustrates a cross-sectional view of the bearing assembly in an unassembled state.

Referring collectively now to FIGS. 4-6, the removable coupling of the bearing support 152 with the side plate support 128 is illustrated. For example, FIG. 4 illustrates a sectional view of a bearing assembly in an assembled state, i.e., when the bearing support 152 is completely received by the side plate support 128. The term "bearing assembly" used herein collectively refers to the bearing support 152 and the rotor bearing 140. In the assembled state, the bearing support 152 is adapted to be coupled to the side plate support 128 with the bolts 160. Further, the bearing support 152 is adapted to be coupled to the rotor bearing 140 with the bearing support key 162 and the bolts 164. It is to be understood that, the bolts 160, the bearing support key 162, and the bolts 164 are not shown in the FIG. 4.

Further, FIG. 5 illustrates a sectional view of the bearing assembly in a partially unassembled state, i.e., when the bearing support 152 is partially moved out of the side plate support 128. Similarly, FIG. 6 illustrates a sectional view of the bearing assembly in an unassembled state, when the hearing support 152 is completely moved out of the side plate support 128. It is to be understood that, in the partial and complete unassembled state, the bearing support 152 is decoupled from the side plate support 128 and the rotor bearing 140 by removing the bolts 160, the bearing support key 162, and the bolts 164.

Figure 7:
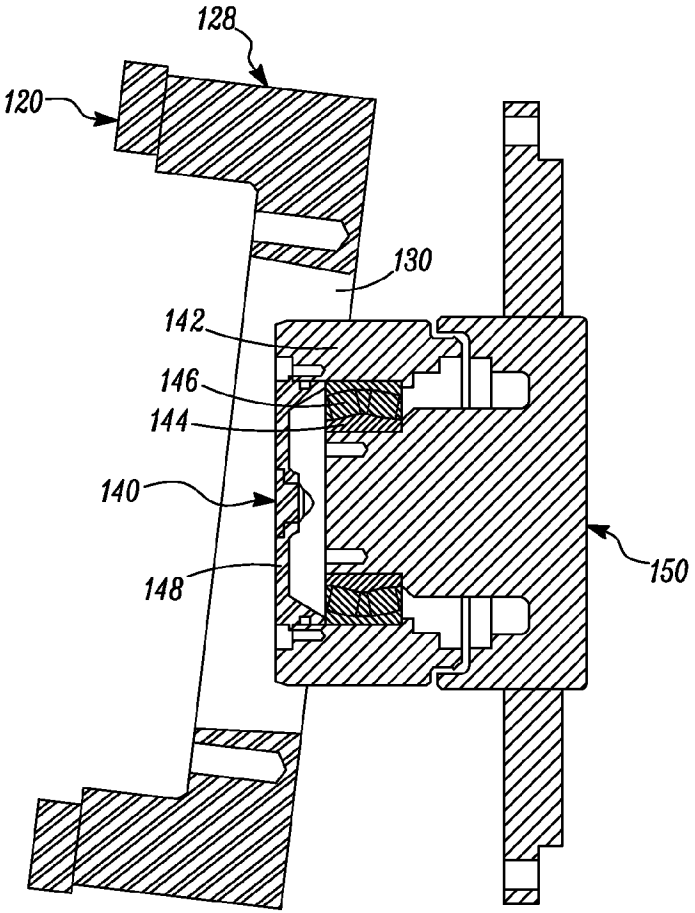
FIG. 7 illustrates a side plate of the chamber in an inclined position.

Referring now to FIG. 7, the side plate 120, particularly, the side plate support. 128 is illustrated in an inclined position with respect to the rotor bearing 140. For example, when the bearing assembly attains the unassembled state (as shown FIG. 6), the side plate 120 may be swung away to articulate in the longitudinal direction with respect to the rotor bearing 140. As stated above, the side plate 120 is pivotally coupled with the support plate 124 using the hinge 126, therefore when the bearing support 152 is removed from the side plate support 128, the side plate 120 may be swung away from the rotor bearing 140. The removable coupling of the bearing support 152 and the side plate support 128 configures a clearance there-between for allowing the side plate 120 to be swung away from the rotor bearing 140. For example, once the bearing support 152 is removed from the opening 130 of the side plate support 128, the opening 130 act as the clearance between the side plate support 128 and the rotor bearing 140.

Once the side plate 120 is swung away, the side plate 120 may be retained in the inclined position for providing access into the chamber 110. For example, when the side plate 120 is swung away, the side plate 120 may be manually retained in the inclined position for gaining access to the rotor bearing 140 and the milling rotor 115. This allows a person to perform cleaning and/or servicing work associated with the rotor bearing 140 and the milling rotor 115. It may be evident to those skilled in the art that the bearing assembly explained herein may be configured on other side of the chamber 110. For example, a similar bearing assembly may be adapted to support another end of the axle that supports the milling rotor 115 thereon.

INDUSTRIAL APPLICABILITY

The milling machine 100 described above may be used for the milling material such as, asphalt or concrete, by using the milling rotor 115. The milling rotor 115 may be transversally supported within the chamber 110 with the help of the rotor bearing 140. The rotor bearing 140 and the milling, rotor 115 may encounter wear and tear over a period of time for which they may need to undergo servicing. Additionally, the rotor bearing 140 and the milling rotor 115 may need to undergo routine servicing, in such instance, the rotor bearing 140 and the milling rotor 115 of the present disclosure may be serviced, in a manner described herein below.

Figure 8:
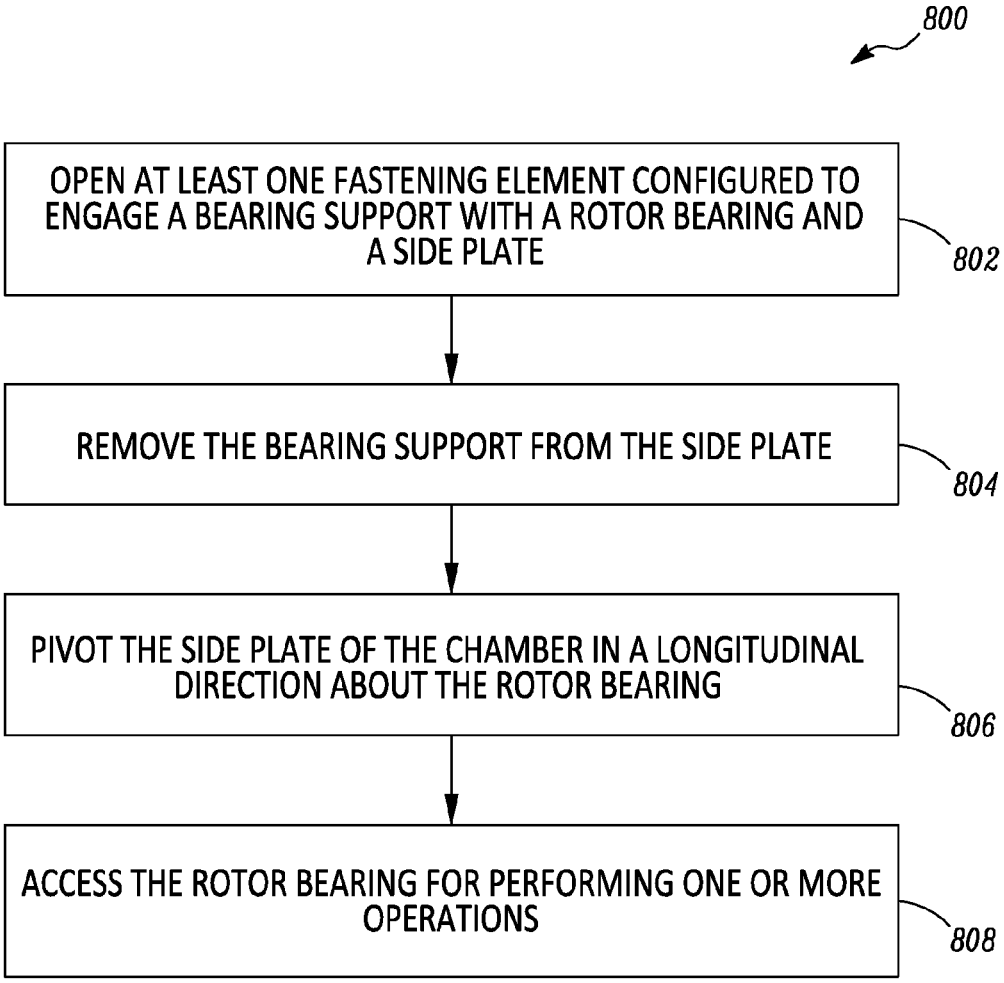
FIG. 8 illustrates a flow chart for assessing the chamber of the machine.

Referring now to FIG. 8, a method 800 for accessing the chamber 110 of the milling machine 100 is shown. The chamber 110 may be accessed for performing one or more operations, which may include but not limited to at least one of servicing or replacing the rotor bearing 140 and the milling rotor 115.

Initially, as shown in step 802, the at least one fastening element, configured to engage the hearing support 152 with the rotor bearing 140 and the side plate support 128, may be opened (removed). For example, the at least one fastening element may include the bolts 160, opened to release the engagement between the bearing support 152 and the side plate support 128. Further, the at least one fastening element may also include the bearing support key 162 and the bolts 164, opened to release the engagement between the bearing support 152 and the rotor bearing 140.

At step 804, the bearing support 152 may be removed from the side plate support 128. For example, when the bolts 160, the hearing support key 162, and the bolts 164 are opened, the bearing support 152 may be decoupled from the rotor bearing 140 and the side plate support 128. As shown in FIG. 6, the bearing support 152 is removed from the side plate support 128.

Thereafter, at step 806, the side plate 120 of the chamber 110 is pivoted in a longitudinal direction about the rotor bearing 140. Once, the bearing support 152 is removed from the side plate support 128, the side plate 120 may be pivoted away from the rotor bearing 140. For example, as shown in FIG. 7, the side plate support 128 is shown in the inclined position, i.e., when the side plate 120 is pivoted away from the rotor bearing 140. It is to be understood that, the bolts 122 need to be removed for decoupling the side plate 120 from the support plate 124, prior to pivoting the side plate 120.

The side plate 120 may be swung away to articulate in the longitudinal direction with respect to the rotor bearing 140. As stated above, the side plate 120 may be pivoted about the hinge 126, when the hearing support 152 is removed from the side plate support 128. For example, upon removing the bearing support 152 from the side plate support 128, the opening 130 may act as the clearance between the side plate support 128 and the rotor bearing 140 for allowing the side plate 120 to swing away.

Finally, at step 808, the rotor bearing 140 may be accessed for performing one or more operations, such as servicing or replacing, the rotor bearing 140. Also, the chamber 110 may be accessed to perform service work related to the milling rotor 115. For example, once the side plate 120 is swung away, the milling rotor 115 may be conveniently removed from within the chamber 110 without any interference.

The side plate 120 may be manually swung away from the rotor bearing 140 and retained in the inclined position for accessing the rotor bearing 140. The manual swinging and retaining the side plate 120 in the inclined position precludes a need for lifting equipment to move the side plate 120, and also prevents a need for fully opening the side plate 120 from the chamber 110. Further, it may be evident to those skilled in the art that the side plate 120 may not be swung away for servicing or replacing the rotor bearing 140. For example, upon removing the bearing support 152 from the side plate support 128, the clearance provided by the opening 130 may be sufficient for a person to perform the operation of servicing or replacing the rotor bearing 140 through the opening 130.

The present disclosure provides an easy and time efficient way to access components, such as the rotor bearing 140 and the milling rotor 115 when the milling machine 100 is not in use. For example, the present disclosure provides a way to reduce the time and steps needed for carrying out the servicing or replacing of the rotor bearing 140 and/or removal of the milling rotor 115 by swinging the side plate 120 without any interference. This will facilitate in preforming the required cleaning and/or servicing of the rotor bearing 140 and the milling rotor 115 in convenient manner. Additionally, the present disclosure provides an interface between the rotor bearing, 140 and the side plate 120 of the chamber 110 during operation of the milling rotor 115.

Although the embodiments of this disclosure as described herein may be incorporated without departing from the scope of the following claims, it will be apparent to those skilled in the art that various modifications and variations can be made. Other embodiments will be apparent to those skilled in the art from consideration of the specification and practice of the disclosure. It is intended that the specification and examples be considered as exemplary only, with a true scope being indicated by the following claims and their equivalents.

What is claimed is:

1. A chamber for a milling machine comprising:

a milling rotor rotatably mounted on the chamber, a side plate mounted on the chamber, transversely to the milling rotor, in a substantially vertical position, wherein the side plate includes a side plate support;

a rotor bearing coupled with the milling rotor;

a bearing support configured to receive the rotor bearing; and at least one fastening element to removably couple the bearing support with the side plate support and the rotor bearing;

wherein the side plate support has an outer surface facing away from the milling rotor and the bearing support is coupled to the outer surface.

2. The chamber of claim 1, wherein the bearing support includes a flange section and a hollow protruded section.

3. The chamber of claim 1, wherein the rotor bearing includes an outer ring, an inner ring, and one or more rolling elements between the outer ring and the inner ring.

4. The chamber of claim 1, wherein the bearing support includes at least one opening for receiving the at least one fastening element.

5. The chamber of claim 4, wherein a flange section of the bearing support includes the at least one opening for receiving the at least one fastening element.

6. The chamber of claim 4, wherein the side plate support includes at least one opening, corresponding to the at least one opening of the bearing support, to receive the at least one fastening element through the bearing support.

7. The chamber of claim 1, wherein the fastening element includes a bolt.

8. The chamber of claim 1, wherein the bearing support includes at least one opening for receiving the at least one fastening element.

9. The chamber of claim 8, wherein a flange section of the bearing support includes the at least one opening for receiving the at least one fastening element.

10. The chamber of claim 1, wherein the side plate support is configured to receive the bearing support.

11. The chamber of claim 10, wherein the side plate support includes an opening configured to receive a hollow protruding section of the bearing support.

12. The chamber of claim 10, wherein the opening is tapered to receive the bearing support.

13. The chamber of claim 1, wherein the bearing support receives an outer ring of the rotor bearing.

14. The chamber of claim 13, wherein a hollow protruded section of the bearing support receives the outer ring of the rotor bearing.

15. A milling machine comprising:

a chamber having a front portion and a rear portion;

a milling rotor rotatably mounted to the chamber;

a side plate hingedly connected to the chamber;

a side plate support integral with the site plate;

a bearing support configured to couple with the side plate support;

a rotor bearing configured to couple with the bearing support; and at least one fastening element to removably couple the bearing support with the side plate support and the rotor bearing;

wherein the side plate support has an outer surface facing away front the milling rotor and the bearing support is coupled to the outer surface.

* * * * *